US006298794B1

(12) United States Patent
Brown et al.

(10) Patent No.: US 6,298,794 B1
(45) Date of Patent: Oct. 9, 2001

(54) ERGONOMIC COMPUTER WORKSTATION

(75) Inventors: Douglas J. A. Brown, Vancouver; Robert W. McLachlan, West Vancouver; Paul J. Conder, Vancouver, all of (CA)

(73) Assignee: Microsphere Inc., Vancouver (CA)

( * ) Notice: Subject to any disclaimer, the term of this patent is extended or adjusted under 35 U.S.C. 154(b) by 0 days.

(21) Appl. No.: 09/383,628

(22) Filed: Aug. 26, 1999

(51) Int. Cl.[7] ..... A47B 35/00

(52) U.S. Cl. ..... 108/50.01; 248/125.8; 248/918

(58) Field of Search ..... 248/918, 122.1, 248/125.1, 125.2, 125.8; 108/50.01, 94, 95; 297/172, 217.3

(56) References Cited

U.S. PATENT DOCUMENTS

| | | | | |
|---|---|---|---|---|
| 2,716,440 | * | 8/1955 | Silverman | 297/172 |
| 4,226,390 | * | 10/1980 | Steggall | 248/125.1 |
| 4,365,561 | | 12/1982 | Tellier . | |
| 4,638,969 | | 1/1987 | Brown . | |
| 4,779,922 | | 10/1988 | Cooper . | |
| 4,848,710 | | 7/1989 | Newman . | |
| 4,915,450 | | 4/1990 | Cooper . | |
| 5,056,864 | * | 10/1991 | Coper | 297/217.3 X |
| 5,126,928 | | 6/1992 | Hughes . | |
| 5,174,223 | | 12/1992 | Nagy et al. . | |
| 5,630,566 | * | 5/1997 | Case | 248/122.1 |
| 5,738,316 | | 4/1998 | Sweere et al. . | |
| 5,765,910 | * | 6/1998 | Larkin et al. | 297/172 |
| 5,857,415 | | 1/1999 | Richard . | |
| 5,868,079 | | 2/1999 | Charny . | |
| 5,918,841 | * | 7/1999 | Sweere et al. | 248/918 X |

* cited by examiner

*Primary Examiner*—Ramon O. Ramirez

(57) ABSTRACT

An ergonomic computer workstation comprises a base, a first vertical shaft supported by the base and a second vertical shaft for supporting a computer monitor thereon, connected to the first vertical shaft by means of a connection which permits vertical adjustment of the second vertical shaft relative to the first vertical shaft. The workstation further includes a keyboard arm for supporting a keyboard thereon. The keyboard arm is pivotally connected to the first or the second vertical shaft, preferably the first vertical shaft, and extends transversely therefrom. The keyboard arm comprises a first arm member which is connected to the vertical shaft at one end and a second arm member pivotally connected to the free end of the first arm. In one particular embodiment the workstation further comprises a monitor arm for supporting a computer monitor thereon pivotally connected to the second vertical shaft and extending transversely therefrom. The monitor arm comprises a first arm member which is connected to the vertical shaft at one end and a second arm member pivotally connected to the free end of the first arm member.

10 Claims, 6 Drawing Sheets

ERGONOMIC COMPUTER WORKSTATION

FIELD OF THE INVENTION

This invention relates to an ergonomic computer workstation.

BACKGROUND OF THE INVENTION

At the present time computers are being utilized in a variety of tasks including employment, recreation and study. Generally, the computer keyboard and monitor are placed on a desk or other support and the computer is connected to the aforementioned components and is generally placed under the desk for support. Numerous devices have been disclosed for supporting keyboards and monitors both independently and together but none of these devices provide the ease of movement necessary to properly encourage the user to adapt ergonomic peripheral configurations. U.S. Pat. No. 5,630,566 discloses a portable ergonomic workstation. However, the design does not provide for ease of adjustment of the often heavy computer monitor due to it's reliance on a single vertical shaft for all movable arms. This shortcoming discourages adjustment of the height of the computer monitor and limits the user to a single working configuration.

It is accordingly an object of the present invention to provide an easily adjustable computer workstation adapted to facilitate working with the computer components placed in their most ergonomic positions.

SUMMARY OF THE INVENTION

According to the invention there is provided an ergonomic computer workstation, comprising a base; a first vertical shaft supported by said base; a second vertical shaft for supporting a computer monitor thereon, connected to said first vertical shaft through connection means permitting vertical adjustment of the second vertical shaft relative to the first vertical shaft; a keyboard arm for supporting a keyboard thereon pivotally connected to one of the first and second vertical shafts and extending transversely therefrom, said keyboard arm comprising a first arm member which is connected to the vertical shaft at one end, and a second arm member pivotally connected to the free end of the first arm member at one end and provided with means for supporting a keyboard thereon.

The workstation may further comprise a monitor arm for supporting a computer monitor thereon pivotally connected to the second vertical shaft and extending transversely therefrom, said monitor arm comprising a first arm member which is connected to the vertical shaft at one end, and a second arm member pivotally connected to the free end of the first arm member at one end and provided with means for supporting a computer monitor thereon.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

The invention will now be described by way of examples, with reference to the accompanying drawings, in which.

DETAILED DESCRIPTION OF PREFERRED EMBODIMENTS

Figure 1:
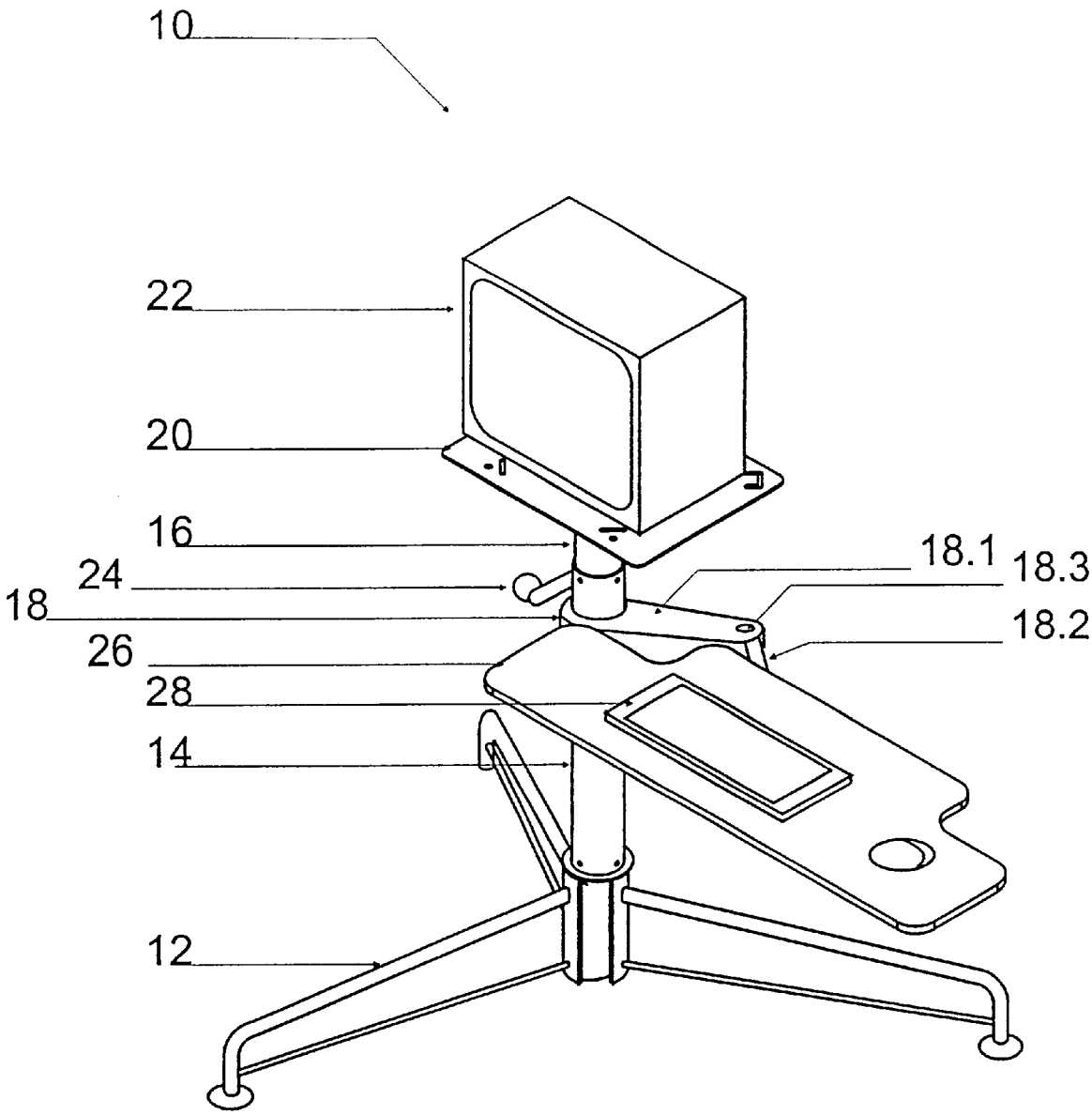
FIG. 1 is a perspective view of a computer workstation according to one embodiment of the invention.

In FIG. 1, reference numeral 10 generally indicates an ergonomic computer workstation comprising a base 12, a first vertical shaft 14 supported by the base 12, a second vertical shaft 16 and a keyboard arm 18.

The second shaft 16 is provided with a platform 20 at its upper end for supporting a computer monitor 22 thereon. The platform 20 is capable of pivotal movement relative to the shaft 16 about a vertical axis to provide for angular adjustment of the monitor 22.

Figure 2:
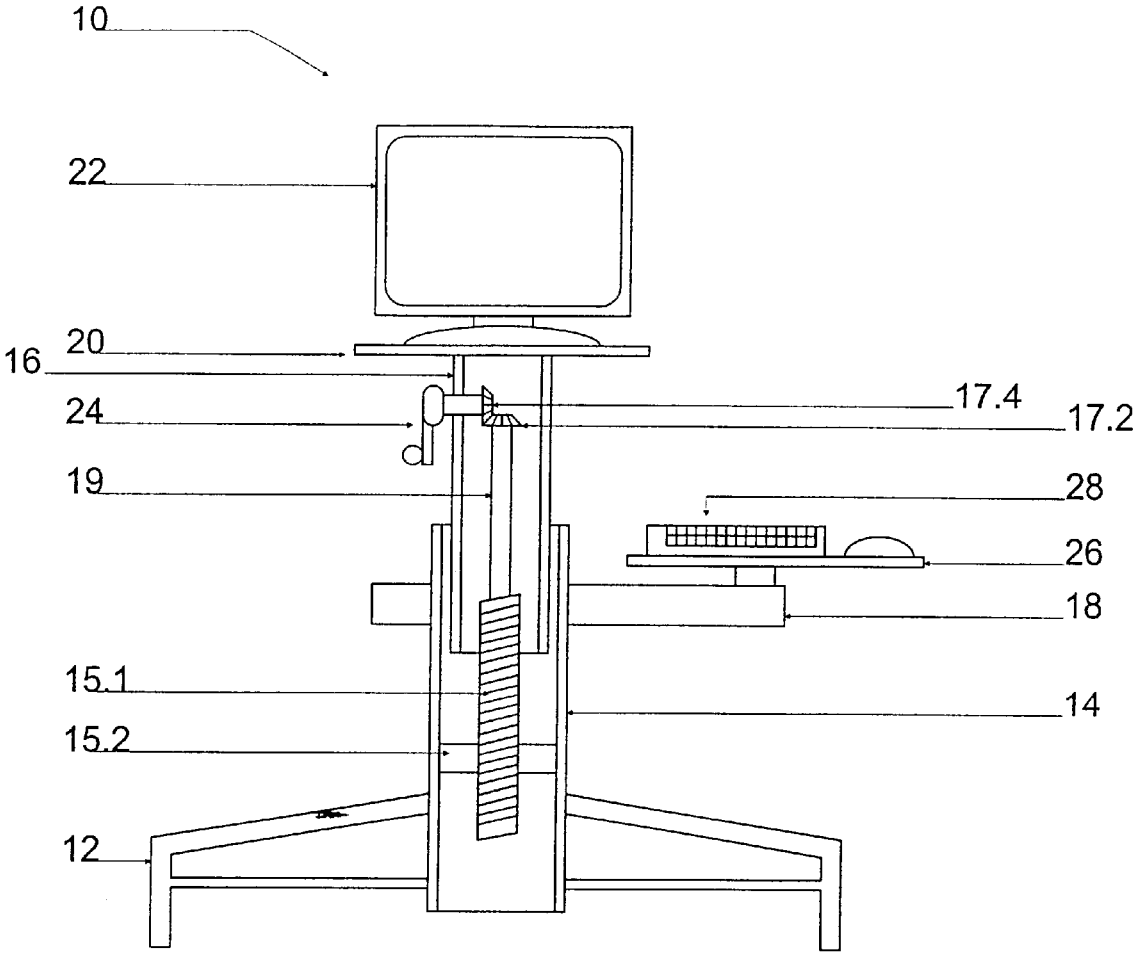
FIG. 2 is a front view of the workstation, partly in section, illustrating a mechanism for adjusting the height of a computer monitor.

The shafts 14 and 16 are concentric and shaft 16 is vertically adjustable relative to the shaft 14 through intermeshing screw threads 15.1, 15.2 (FIG. 2) and a crank handle 24 which is connected to the screw thread 15.1 through bevel gears 17.1, 17.2 and shaft 19. By rotating the handle 24 the shaft 16 can be raised or lowered relative to the shaft 14 while the intermeshing screw threads 15.1, 15.2 support the weight of the monitor 22. Therefore, it is not necessary for the user to lift or support the weight of the monitor 22 while adjusting the height of the monitor 22.

The keyboard arm 18 comprises a first arm portion 18.1, which is pivotally connected to the first shaft 14 at one end, and a second arm portion 18.2, pivotally connected to the first arm portion 18.1 at 18.3, and provided with a platform 26 at its free end for supporting a computer keyboard 28 thereon.

The platform 26 is capable of pivotal movement about a vertical axis relative to the arm portion 18.2 to provide for adjustment of the keyboard in a left or right direction.

Figure 3:
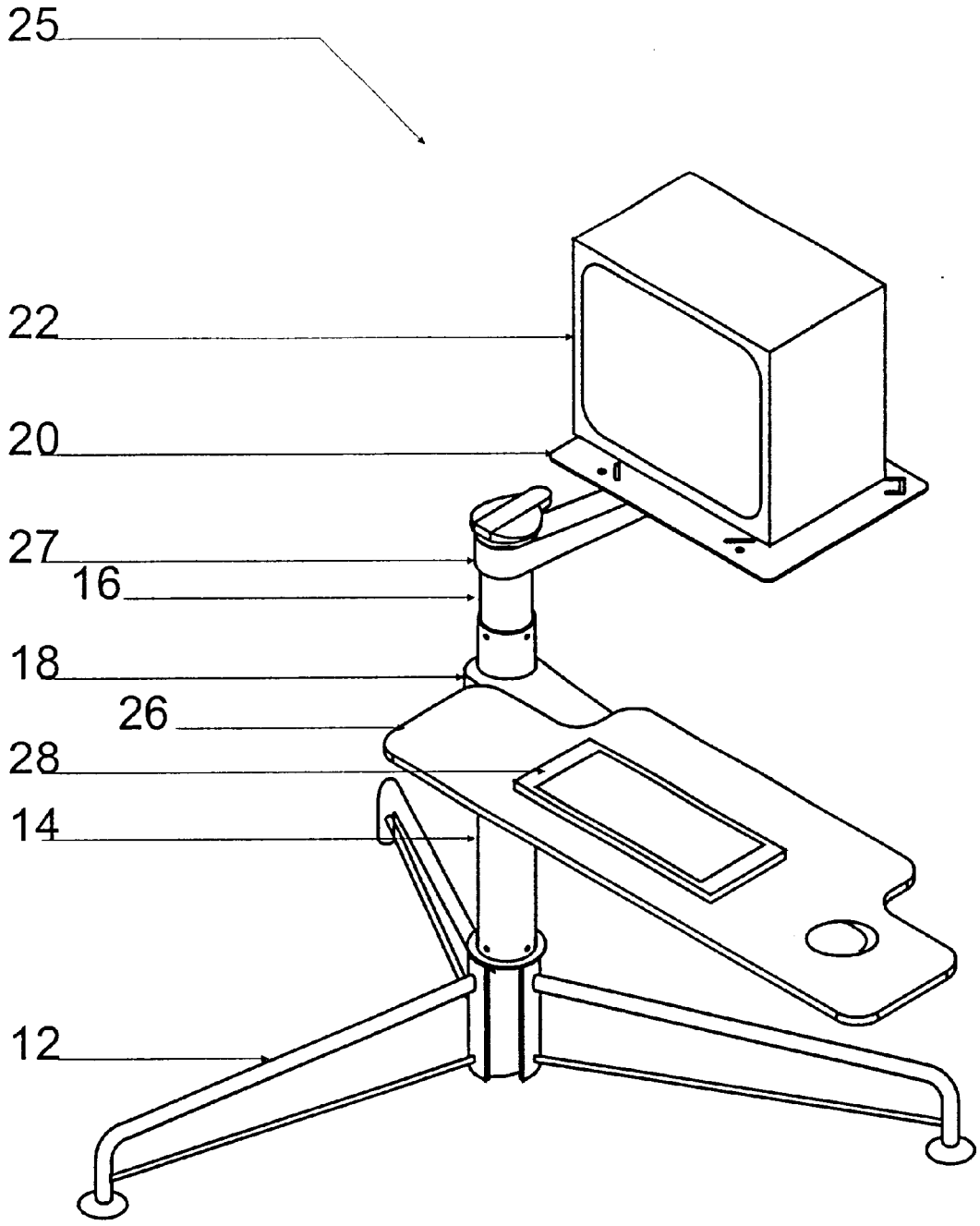
FIG. 3 is a perspective view of a computer workstation according to another embodiment of the invention.

In FIG. 3, an alternative embodiment 25 of the invention is shown in which the monitor platform 20 is connected to the shaft 16 through an angled support shaft 27. The shaft 27 is capable of pivotal movement relative to the shaft 16 about a vertical axis. Likewise, the platform 20 is capable of pivotal movement relative to the shaft 27 about a vertical axis.

Figure 4:
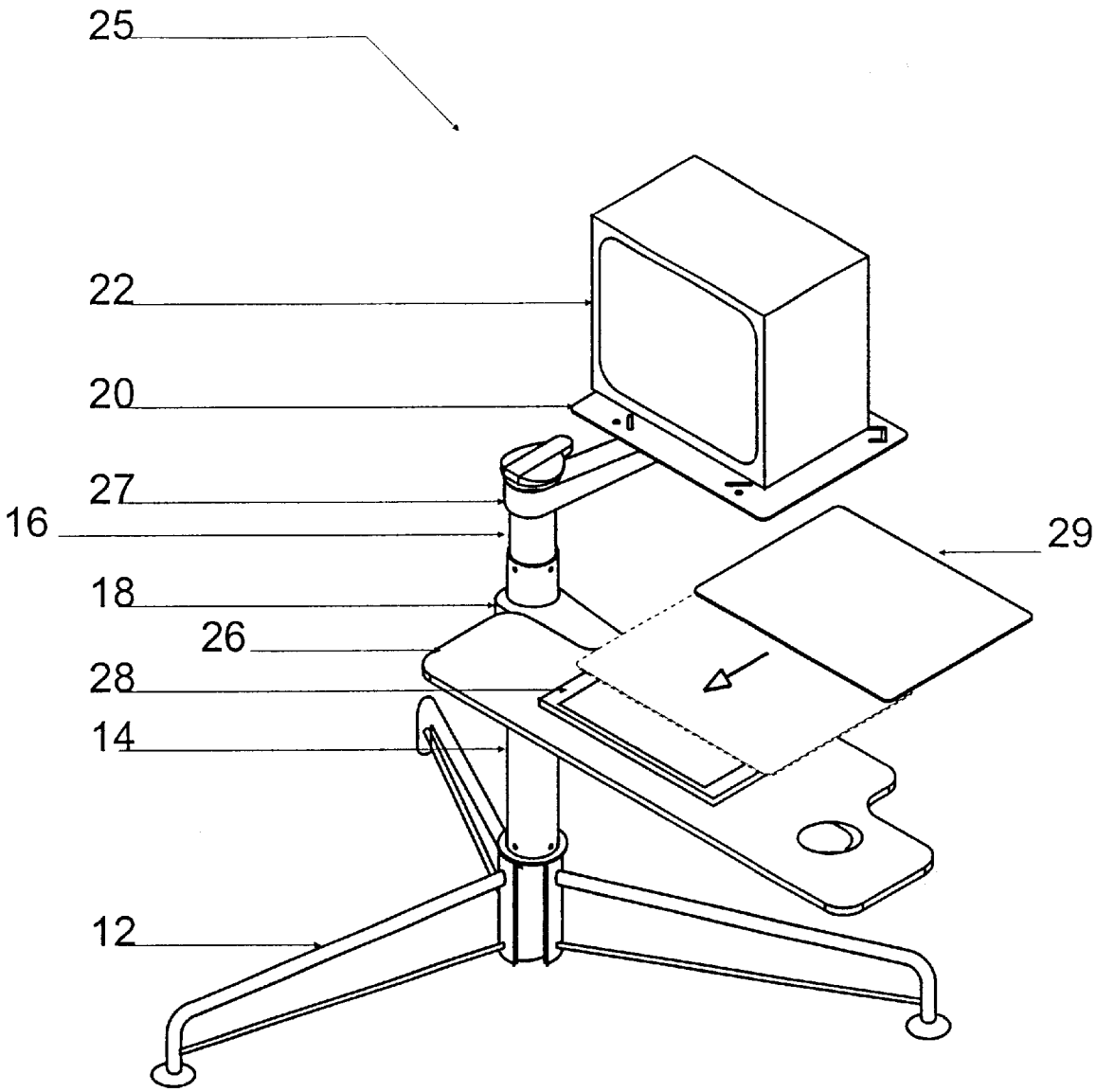
FIG. 4 is a view similar to FIG. 3 but showing a utility surface attached to a keyboard support surface of the workstation.

FIG. 4 shows the same embodiment but with a utility surface 29 connected to the keyboard platform 26. The surface 29 is shown to be slidably attached to the platform 26 so that it can be slided over the platform 26 when not in use, as shown in broken lines. When in the extended position (solid lines), it can be used to support text or a writing pad.

Figure 5:
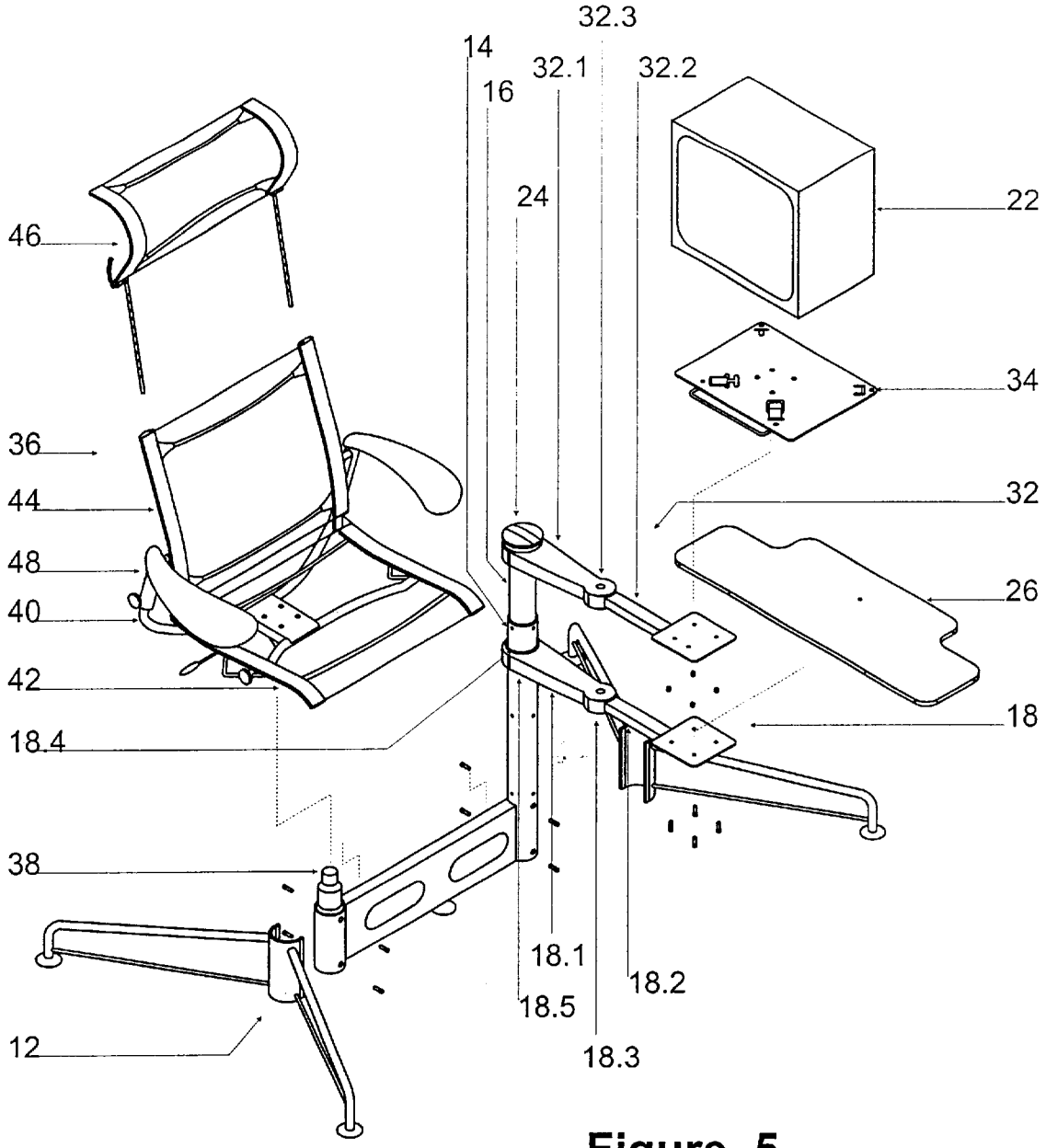
FIG. 5 is an exploded perspective view of a computer workstation according to another embodiment of the invention.

With reference to FIG. 5, reference numeral 30 generally indicates an ergonomic computer workstation according to another embodiment of the invention. The workstation also comprises a base 12 supporting a first vertical shaft 14, a second vertical shaft 16, concentric with the first vertical shaft 14, and a keyboard arm 18, comprising first and second arm portions 18.1., 18.2, pivotally connected together at 18.3, and a keyboard platform 26 for supporting a computer keyboard 28 thereon. Again, the platform 26 is capable of pivotal movement about a vertical axis relative to the arm portion 18.2 to provide for adjustment in a left and right direction.

The arm portion 18.1 is provided with an opening 18.4 at one end which allows the shaft 14 to pass therethrough so that the arm portion 18.1 can slide along the length of the shaft 14. A clamping mechanism 18.5 is provided for clamping the arm portion 18.1 to the shaft 14 at a desired position along the shaft 14. In this way the keyboard arm 18 is height adjustable.

The second shaft 16 is provided with a monitor arm 32 at its upper end. The arm 32 comprises a first arm portion 32.1, which is pivotally connected to the second shaft 16 at one end, and a second arm portion 32.2, pivotally connected to the first arm portion 32.1 and 32.3, and provided with a platform 34 at its free end for supporting a computer monitor 22 thereon. The platform 34 is capable of pivotal movement about a vertical axis relative to the arm portion 34.2 for angular adjustment of the monitor 22.

The second shaft 16 is capable of telescoping movement relative to the first shaft 14, through intermeshing screw threads (not shown) and a crank handle 24, whereby the shaft 16 can be raised or lowered relative to the shaft 14 while the intermeshing screw threads support the weight of the monitor 22. As in the case of the embodiment of FIG. 1, it is not necessary for the user to lift or support the weight of the monitor 22 while adjusting the height of the monitor 22.

A chair 36 is mounted on the base 12 through a piston and bracket assembly 38, allowing for rotation of the chair 36 relative to the base 12. The chair 36 comprises a lower frame subassembly 40, seat assembly 42, back assembly 44 and headrest assembly 46, as well as arm rest subassembly 48.

Figure 6:
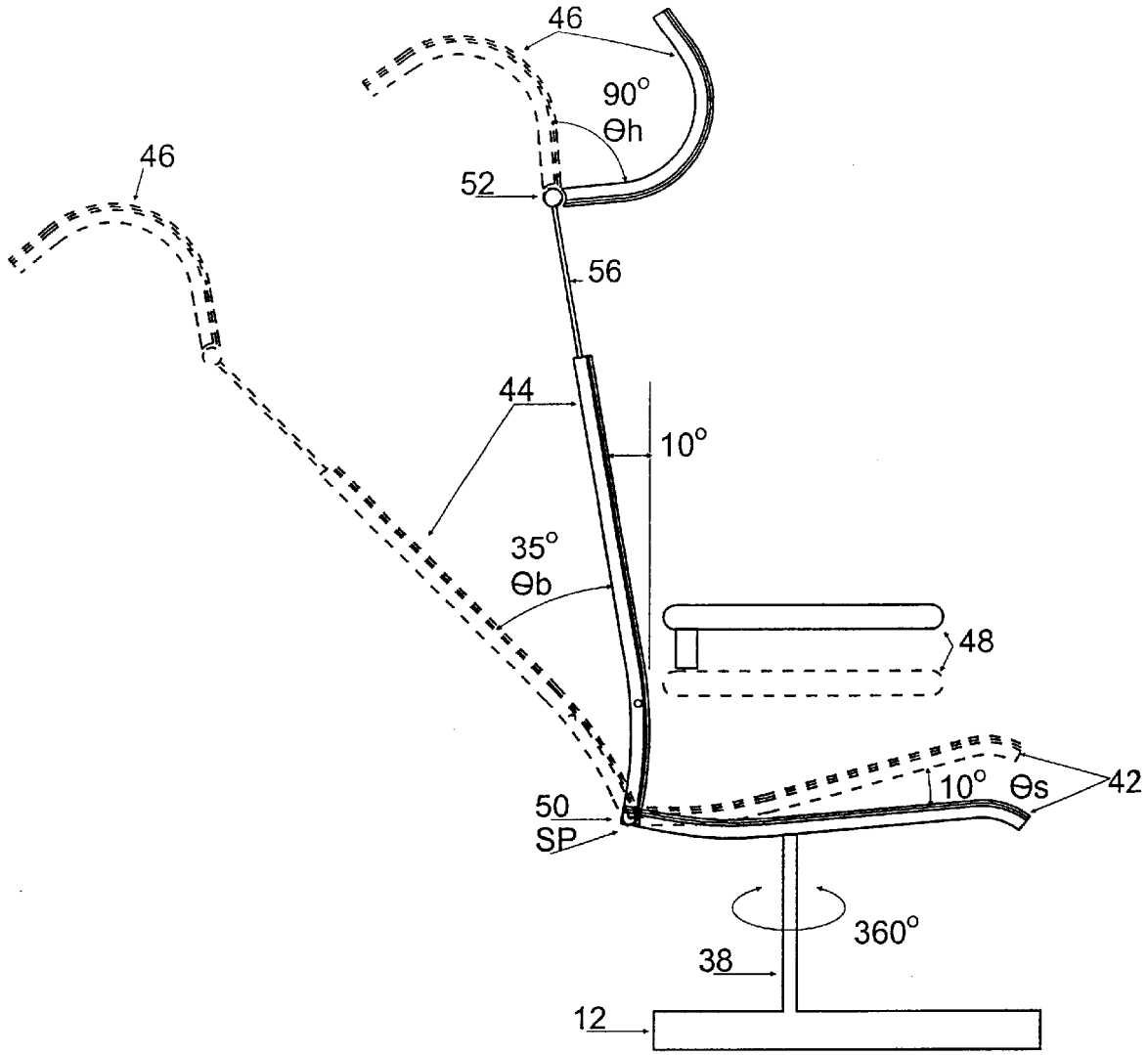
FIG. 6 is a schematical side view of a chair of the workstation of FIG. 5, illustrating the adjustment capabilities of the chair.

The chair 36 can be adjusted between an upright seating position and a reclined position. This is schematically illustrated in FIG. 6. The back assembly 44 and the seat assembly 42 are pivotally connected to the frame subassembly at 50. This allows the back assembly 44 to be adjusted in a range of positions between a pair of limiting positions, respectively, shown in solid and broken lines in the drawing. The solid line position is a about 10° offset from the vertical position, as shown. Likewise, the seat assembly 42 is adjustable through a range of positions between a pair of limiting positions shown in solid and broken lines, respectively. As shown, the angle between the limiting positions is about 10°.

The headrest subassembly 46 is pivotally connected to the back assembly 44 at 52 permitting adjustment of the headrest subassembly 46 through a range of positions between a pair of limiting positions, respectively shown in solid and broken lines. As shown, the angle between the limiting positions is about 90°.

The arm rest subassembly 48 is height adjustable through a range of positions between a pair of limiting positions, respectively shown in solid and broken lines. For this purpose a vertical telescoping assembly 54 is provided to which the arm rest subassembly 48 is attached.

Likewise, a telescoping assembly 56 is provided on the back assembly 44 to provide for height adjustment of the headrest assembly 46 relative to the back assembly 44.

If desired, computer speakers (not shown) may be mounted in the headrest assembly.

The present invention provides a computer workstation which facilitates easy adjustment of the computer peripherals and therefore encourages multiple ergonomic working position. In addition, the workstation provides continuous support for a heavy peripheral, such as a computer monitor, during vertical adjustment thereof.

Although certain preferred embodiments of the present invention have been shown and described in detail, it should be understood that various changes and modifications may be made therein without departing from the scope of the appended claims.

We claim:

1. An ergonomic computer workstation, comprising:

a base;

a first vertical shaft supported by said base;

a second vertical shaft for supporting a computer monitor thereon, connected to said first vertical shaft through connection means permitting vertical adjustment of the second vertical shaft relative to the first vertical shaft while supporting the weight of the second vertical shaft during said vertical adjustment;

a keyboard arm for supporting a keyboard thereon pivotally connected to one of the first and second vertical shafts and extending transversely therefrom, said keyboard arm comprising a first arm member which is connected to the vertical shaft at one end, and a second arm member pivotally connected to the free end of the first arm member at one end and provided with means for supporting a keyboard thereon.

2. The workstation according to claim 1, further comprising a monitor arm for supporting a computer monitor thereon pivotally connected to the second vertical shaft and extending transversely therefrom, said monitor arm comprising a first arm member which is connected to the vertical shaft at one end, and a second arm member pivotally connected to the free end of the first arm member at one end and provided with means for supporting a computer monitor thereon.

3. The workstation according to claim 2, wherein said monitor arm is located at an upper end of the second vertical shaft.

4. The workstation according to claim 1, wherein said keyboard arm is connected to the first vertical shaft.

5. The workstation according to claim 1, wherein said first and second vertical shafts are concentric.

6. The workstation according to claim 1, wherein said second vertical shaft has an angled portion at its upper end which is provided with means for supporting a computer monitor thereon.

7. The workstation according to claim 1, further comprising a chair mounted on said base.

8. The workstation according to claim 7, wherein the chair has a seat portion and a back portion adjustable between an upright seating position and a reclined position.

9. The workstation according to claim 7, wherein said chair is provided with a headrest having a speaker mounted therein.

10. The workstation according to claim 1, wherein said connection means permitting vertical adjustment of the second vertical shaft relative to the first vertical comprises intermeshing screw threads provided on the first and second shafts, respectively.

* * * * *